US008752815B2

(12) United States Patent
Powers

(10) Patent No.: US 8,752,815 B2
(45) Date of Patent: Jun. 17, 2014

(54) SYSTEM AND METHOD FOR PROCESSING MULTI-PAGE MAIL PIECES

(75) Inventor: Mike Powers, Concord, NH (US)

(73) Assignee: Polaris Direct, Hooksett, NH (US)

( * ) Notice: Subject to any disclaimer, the term of this patent is extended or adjusted under 35 U.S.C. 154(b) by 804 days.

(21) Appl. No.: 12/899,332

(22) Filed: Oct. 6, 2010

(65) Prior Publication Data

US 2011/0214542 A1 Sep. 8, 2011

Related U.S. Application Data

(60) Provisional application No. 61/249,173, filed on Oct. 6, 2009.

(51) Int. Cl.
*B65H 39/16* (2006.01)

(52) U.S. Cl.
CPC ..... *B65H 39/16* (2013.01)
USPC ..... 270/52.08; 270/52.07; 270/52.09

(58) Field of Classification Search
CPC ..... B65H 39/16
USPC ..... 270/5.01, 5.02, 20.1, 21.1, 52.07, 270/52.08, 58.09
See application file for complete search history.

(56) References Cited

U.S. PATENT DOCUMENTS

| | | | | |
|---|---|---|---|---|
| 5,282,350 | A * | 2/1994 | Crowley | 53/435 |
| 5,505,401 | A | 4/1996 | Lamothe | |
| 5,992,789 | A | 11/1999 | Lamothe | |
| 6,402,136 | B1 | 6/2002 | Lamothe | |
| 6,994,005 | B2 | 2/2006 | Lamothe | |
| 7,611,134 | B2 * | 11/2009 | Sussmeier et al. | 270/52.09 |
| 8,437,014 | B2 * | 5/2013 | Delfer et al. | 358/1.12 |
| 8,480,068 | B2 * | 7/2013 | Fujio et al. | 270/5.03 |

* cited by examiner

*Primary Examiner* — Leslie A Nicholson, III
(74) *Attorney, Agent, or Firm* — Preti Flaherty Beliveau & Pachios LLP

(57) ABSTRACT

Systems and methods for processing multi-page mail pieces include a first unwinder that produces single width web and a second unwinder that produces a double width web. A merger/aligner having a slitter is located downstream from the second unwinder, and a cutter is located downstream from the merger/aligner. The slitter slits the double width web into two single width webs, and all of the single width webs are fed into the cutter. The cutter cuts the webs cross-wise at appropriate locations to separate the webs into individual sheets of a desired length.

7 Claims, 4 Drawing Sheets

SYSTEM AND METHOD FOR PROCESSING MULTI-PAGE MAIL PIECES

CROSS REFERENCES TO RELATED APPLICATIONS

This application claims the benefit of U.S. Provisional Application No. 61/249,173, filed Oct. 6, 2009, which is hereby incorporated by reference.

BACKGROUND OF THE INVENTION

This invention relates generally to mail pieces for direct-mail marketing and more particularly to systems and methods for processing multi-page mail pieces.

Direct-mail marketing, which entails the mailing of marketing material (often but not necessarily in letter format) directly to postal recipients, has become a significant form of marketing. Direct mail campaigns often involve thousands, or even millions, of mailings. In order to cost-effectively produce large volume mailings, the printing and processing of the mail pieces are automated. This is typically accomplished by printing the desired information on one or more webs of paper continuously fed through high speed printers and then wound into rolls. The roll or rolls of printed paper are then transferred to a processing system. The printed paper is drawn as one or more webs through the processing system, which cuts, handles, folds and/or otherwise processes the webs to produce the mail pieces.

Multi-page mail pieces are common in the direct mail industry. Existing processing systems are adept at handling multi-page mail pieces having an even number of pages, but multi-page mail pieces with an odd number of pages are more difficult to produce in a cost-efficient manner with conventional processing systems. For instance, while a four-page mail piece would be relatively easy to produce, a five-page mail piece would require either a blank sixth page (leading to waste and increased material cost) or having the fifth page inserted separately (resulting to increased processing time and labor costs).

It is also highly desirable to provide personalization to large volume mail pieces. In the direct mail industry, "personalization" refers to the inclusion on individual mail pieces of information that is unique to the intended recipient of each mail piece. Such personalized information can include the recipient's name, address, account number, gender, age, etc. Personalization presents additional difficulty in multi-page mail pieces because the personalized information from recipient-to-recipient is likely to involve differing numbers of characters, meaning that the page makeup can vary for each mail piece. In other words, if the first page of a multi-page mail piece contains personalized information, then the page break at the end of page one will not necessarily be the same for each mail piece. Accordingly, the page makeup for each subsequent page will need to be adjusted as well. Thus, for each mail piece, the first page needs to be correlated with the subsequent pages that correspond to the first page (i.e., have the proper page makeup and pagination to go along with the personalized first page).

SUMMARY OF THE INVENTION

The present invention provides systems and methods for processing multi-page mail pieces that overcome the above-mentioned problems. In one embodiment, the system includes a first unwinder that produces single width web and a second unwinder that produces a double width web. A merger/aligner having a slitter is located downstream from the second unwinder, and a cutter is located downstream from the merger/aligner. The slitter slits the double width web into two single width webs, and all of the single width webs are fed into the cutter. The cutter cuts the webs cross-wise at appropriate locations to separate the webs into individual sheets of a desired length.

DETAILED DESCRIPTION OF THE INVENTION

Figure 1:
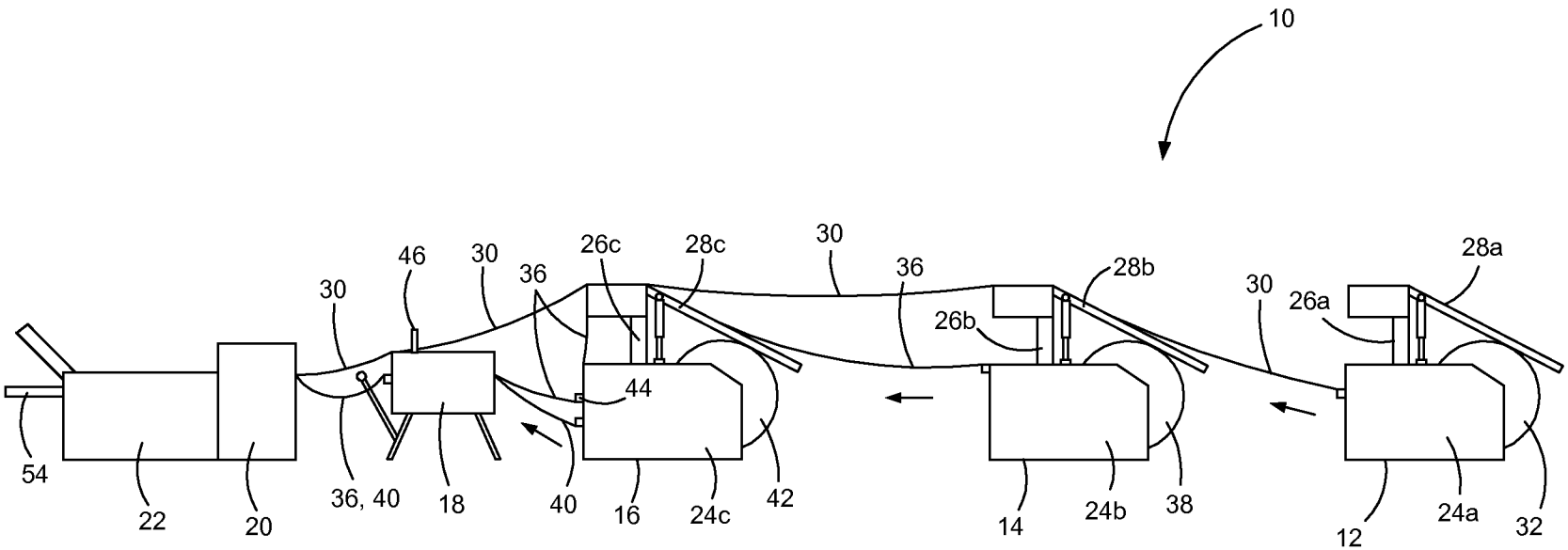
FIG. 1 is a schematic view of a system for processing multi-page mail pieces.

Referring to the drawings wherein identical reference numerals denote the same elements throughout the various views, FIG. 1 shows one embodiment of a system 10 for processing multi-page, personalized mail pieces. In the illustrated embodiment, the system 10 includes first, second and third unwinders 12, 14, 16, a merger/aligner 18, a cutter 20, and a folder 22. Three unwinders are shown for purposes of illustration, but it should be noted that the present invention could include a different number of unwinders—the number of unwinders used being primarily determined by the number of pages desired for the mail piece. The system 10 is described herein as processing a five-page mail piece, but the present invention is also applicable to processing multi-page mail pieces having different numbers of pages.

Each unwinder supports a roll of paper or similar material and includes means to rotate the roll so as to unwind or pay out a web of the material. The three unwinders 12, 14, 16 are oriented so that each one pays out its web in the same direction. The system 10 thus has a "longitudinal direction," which refers generally to the overall direction of the movement of the webs, which is from right to left in FIG. 1, as depicted by the arrows. The three unwinders 12, 14, 16 are aligned in the longitudinal direction, with the second unwinder 14 located upstream of or behind (with respect to the longitudinal direction) the third unwinder 16 and the first unwinder 12 located upstream of or behind the second unwinder 14.

The unwinders 12, 14, 16 are typically commercially available devices. One suitable commercially available unwinder is the ESP400m Roll Unwind Processor offered by Energy Saving Products and Sales Corporation (ESP) of Burlington, Conn. Generally, each unwinder includes a frame 24*a*, 24*b*, 24*c* having two vertically extending side walls and means for rotatively supporting a roll of paper or similar material between the side walls. Two upright supports 26*a*, 26*b*, 26*c* extend upwardly from the side walls. A panel structure 28*a*, 28*b*, 28*c* is pivotally attached to the upper ends of the corresponding upright supports 26*a*, 26*b*, 26*c* and extends rearward over the roll. As is known in the art, a friction drive belt (not shown) is provided on the underside of the panel structure 28*a*, 28*b*, 28*c*. The pivoting panel structure 28*a*, 28*b*, 28*c* tilts downwardly under the force of gravity such that the drive belt tangentially engages the roll. Activating the drive belt (which is typically driven by a variable speed motor) rotates the roll and causes a web to be paid out. Each unwinder 12, 14, 16 is typically provided with one or more rollers or guide bars for directing the advancement of its web and creating a tension free loop in the web, if desired.

Figure 2:
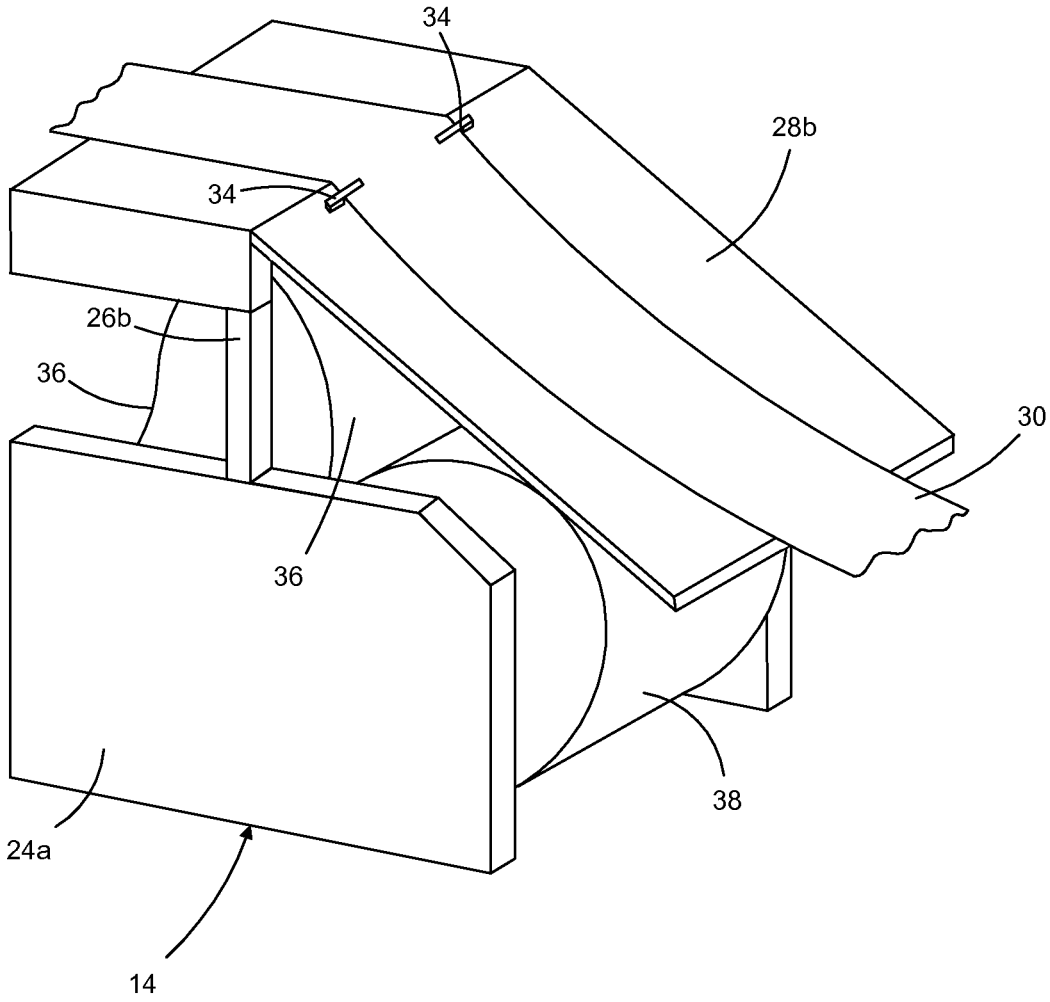
FIG. 2 is a perspective view of an unwinder from the mail piece processing system of FIG. 1.

More specifically, the first unwinder 12 pays out a first web 30 from a first roll 32. In the illustrated embodiment, the first web 30 has the content of one page of the five-page mail piece repeatedly printed thereon along its length. The first web 30 is thus a "single width web," meaning that the width of the web is equal to the page width of the mail piece (plus the width of any pin hole strips) being processed by the system 10. Standard letter-sized sheets, for example, would have a page width of 8.5 inches. The first web 30 travels over the second unwinder 14, riding on the upper surface of the second panel structure 28*b*. As seen in FIG. 2, the second unwinder 14 is modified to include guides 34 mounted on the upper surface of the second panel structure 28*b* for laterally positioning the first web 30. The guides 34 are spaced apart a distance substantially equal to the width of the first web 30 and have inward extensions that the first web travels under.

The second unwinder 14 pays out a second web 36 from a second roll 38. The second web 36 in this embodiment has the content of two pages of the five-page mail piece printed thereon, arranged in side-by-side columns of each page repeating along the length of the web 36. The second web 36 is thus a "double width web," meaning that the width of the web is equal to twice the page width of the mail piece (plus the width of any pin hole strips). The second web 36 travels over the third unwinder 16, riding on the upper surface of the third panel structure 28*c*. The third unwinder 16 is modified in a manner similar to the second unwinder 14 to include guides mounted on the upper surface of the third panel structure 28*c* for laterally positioning the second web 36. The first web 30 also travels over the third unwinder 16, on top of the second web 36.

The third unwinder 16 pays out a third web 40 from a third roll 42. The third web 40 in this embodiment is also a double width web having two pages of the five-page mail piece printed thereon in repeating, side-by-side fashion. Thus, the three webs 30, 36, 40 provide the five sheets that make up the mail piece in this example. This embodiment provides a multi-page mail piece having an odd number (five) of pages by using two webs each providing two pages and another web providing one page. It should be noted, however, that variations of this arrangement can also achieve the desired result. For instance, it is possible to produce a five-page mail piece with the present invention using one web providing three pages and another web providing two pages (in which case, only two unwinders would be needed). The present invention encompasses (but is not limited to) any system that produces a multi-page mail piece having an odd number of pages utilizing at least one web that produces an odd number of pages.

After passing over the top of the third unwinder 16, the second web 36 travels downward in front of the third unwinder 16 and then passes around an additional roller or guide bar 44 (see FIG. 1) located at the front or discharge end of the third unwinder 16. The second and third webs 36, 40 are both fed from the third unwinder 16 to the merger/aligner 18, which is located downstream from, and longitudinally aligned with, the third unwinder 16. The merger/aligner 18 is typically a commercially available device. Suitable merger/aligner devices are commercially available from Moore Business Forms, Inc. of Grand Island, N.Y. The first web 30 passes over the merger/aligner 18, which can include a guide 46 on its upper surface (see FIG. 1) for guiding the first web 30. The second and third webs 36, 40 are fed into the merger/aligner 18 in overlaying fashion, with the second web 36 on top of the third web 40. The two webs 36, 40 are aligned both widthwise and lengthwise. The lengthwise alignment is such that the side-by-side pages of the second web 36 are directly over the corresponding pages of the third web 40, so that the corresponding pages are correlated with one another. This alignment allows for personalization of individual mail pieces, as discussed in more detail below.

Figure 3:
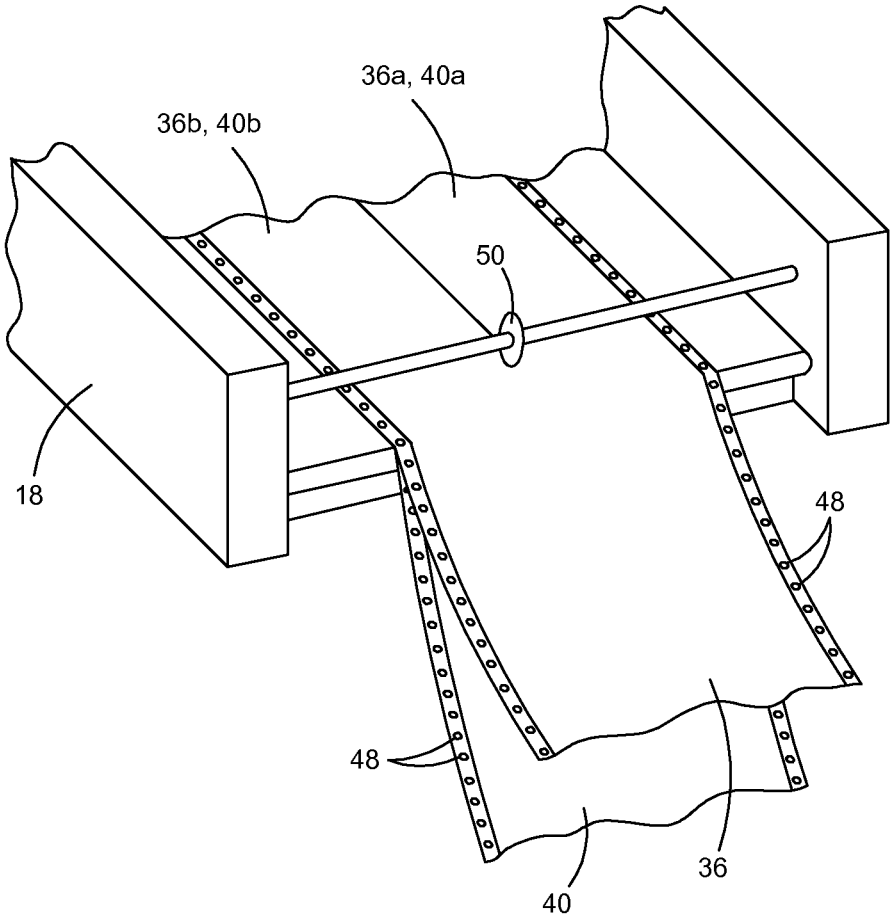
FIG. 3 is a partially cut-away perspective view of a merger/aligner from the mail piece processing system of FIG. 1.

Referring to FIG. 3, it is seen that the second and third webs 36, 40 have strips with pin holes 48 formed along each side edge thereof. These pin holes 48 are engaged by drive means (which are standard in most commercially available merger/aligners) to advance the webs 36, 40 through the merger/aligner 18. As the webs 36, 40 advance together through the merger/aligner 18, they move past a slitter 50, which is located in the center of the webs' path of travel. The slitter 50 slits the two webs 36, 40 lengthwise along their longitudinal centerlines, thereby cutting each of the double-width webs 36, 40 into two single-width webs 36*a*, 36*b* and 40*a*, 40*b*, respectively. These four single-width webs are initially divided into a first stacked set 36*a*, 40*a* on one side and a second stacked set 36*b*, 40*b* on the other side. Each one of the four webs 36*a*, 36*b* and 40*a*, 40*b* comprises one of the pages of the multi-page mail piece. The lengthwise page alignment for both sets of webs is maintained in the merger/aligner 18.

Figure 4:
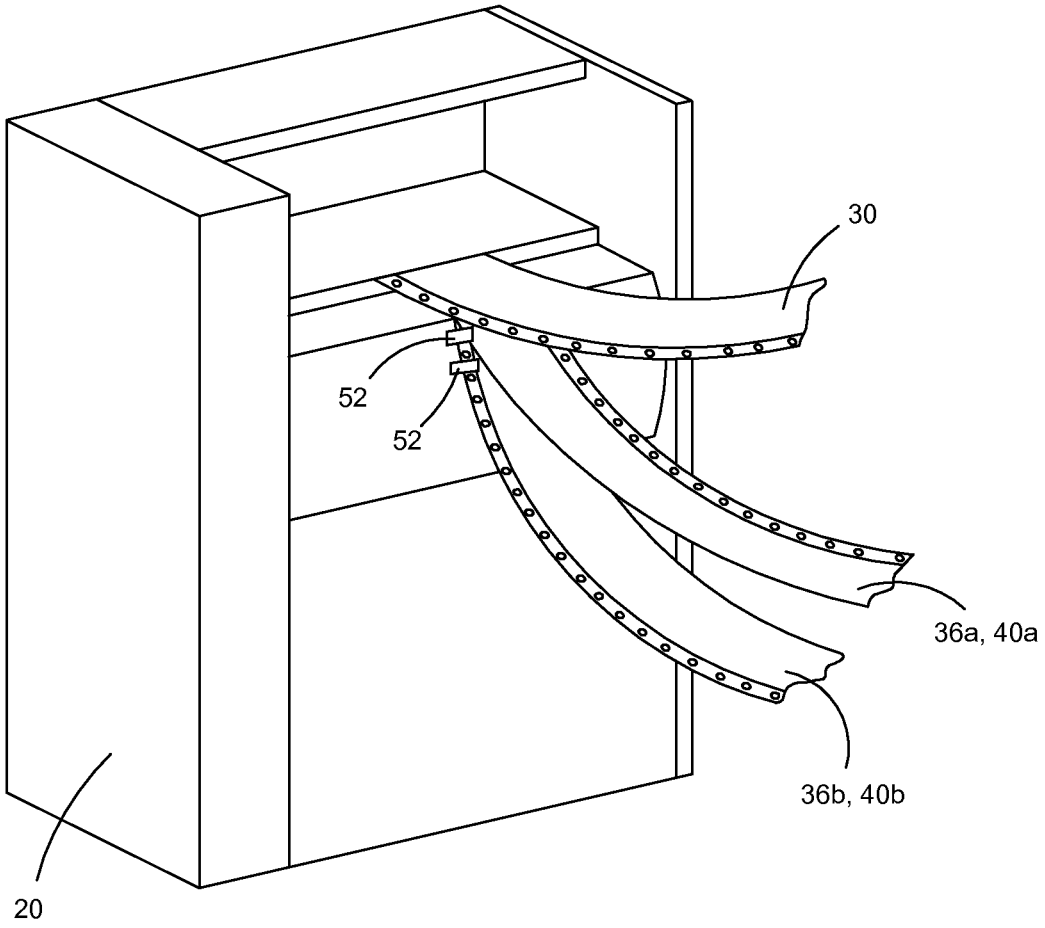
FIG. 4 is a perspective view of a cutter from the mail piece processing system of FIG. 1.

Referring to FIG. 4, the two sets of stacked, single-width webs 36*a*, 40*a* and 36*b*, 40*b* are merged as they travel from the merger/aligner 18 to the cutter 20, which is located downstream from, and longitudinally aligned with, the merger/aligner 18. In the illustrated embodiment, the first set of webs 36*a*, 40*a* is merged on top of the second set of webs 36*b*, 40*b* to form a stack of four single-width webs.

The four merged single-width webs 36*a*, 40*a*, 36*b*, 40*b* are fed together into the cutter 20 together with the single-width first web 30 overlaying the other webs. The cutter 20 is typically a commercially available device. One suitable commercially available cutter is the Bowe 310 Speed cutter offered by Bowe Bell and Howell. A number of guides 52 are provided on the cutter 20 for guiding the webs into the cutter 20. The five webs are aligned lengthwise. That is, the five webs are aligned in page-to-page correlation so that each page of the first web 30 is located directly over the corresponding page of the top web 36*a* of the first set, and each page of the top web 36*a* of the first set is located directly over the corresponding page of the second web 40*a* of the first set, and so on. This longitudinal alignment allows for personalization of individual mail pieces. That is, because all of the pages for any particular mail piece are correlated with one another, the mail pieces can be provided with personalization, such as name, address, age, gender, etc., and such personalization will not impair the page makeup or pagination of individual mail pieces. Personalization that appears on more than one of the pages is also facilitated.

With the five webs so stacked and aligned, the cutter 20 cuts the webs cross-wise at appropriate locations along the length of the webs (i.e., between pages) thereby separating the webs into individual sheets of the desired length. For example, the sheets would be 11 inches in length for standard, letter-sized pages. The result is a stack of five sheets or pages arranged in the desired page order for the mail piece. For instance, if the webs 30, 36, 40 are drawn through the system 10 in a face down orientation, then the bottommost sheet of the stack would be the first page of the mail piece, and the uppermost sheet of the stack would be the fifth and last page of the mail piece. All pin hole strips are also separated from the side edges of the webs in the cutter 20.

Each five-sheet stack is discharged from the outlet of the cutter 20 and deposited onto a conveyor belt of the folder 22, which is located immediately downstream of the cutter 20.

The folder 22, which can be any suitable folding device (one suitable commercially available folder is the IFF21 In-feed folder offered by MBO America of Westampton, N.J.), folds the stack into the desired configuration for mailing. For instance, the stack could be folded into thirds for insertion into a standard letter envelope. Alternatively, a mailing label could be affixed to the mail piece in lieu of insertion into an envelope. The folded mail piece—completely processed and ready for mailing—is discharged to a chute 54 (see FIG. 1) at the outlet of the folder 22.

While specific embodiments of the present invention have been described, it should be noted that various modifications thereto can be made without departing from the spirit and scope of the invention as defined in the appended claims.

What is claimed is:

1. A system for processing multi-page mail pieces, said system comprising:

a first unwinder;

a first roll of material supported by said first unwinder, said first roll of material providing a first single width web;

a second unwinder located downstream from said first unwinder;

a second roll of material supported by said second unwinder, said second roll of material providing a first double width web;

a merger/aligner located downstream from said second unwinder, said merger/aligner including a slitter;

a cutter located downstream from said merger/aligner;

wherein said first single width web travels over said second unwinder and said merger/aligner to said cutter; and wherein said first double width web travels to said merger/aligner where said slitter slits said double width web into second and third single width webs, said second and third single width webs being fed into said cutter with said first single width web.

2. The system of claim 1 wherein said cutter cuts said single width webs cross-wise at appropriate locations to separate said single width webs into individual sheets of a desired length.

3. The system of claim 1 wherein all of said single width webs are aligned lengthwise in said cutter to allow for personalization of individual mail pieces.

4. The system of claim 1 further comprising one or more guides mounted to said second unwinder for positioning said first single width web as it travels over said second unwinder.

5. The system of claim 1 wherein said merger/aligner includes at least one guide for guiding said first single width web over said merger/aligner.

6. The system of claim 1 further comprising:

a third unwinder located between said second unwinder and said merger/aligner;

a third roll of material supported by said third unwinder, said third roll of material providing a second double width web;

wherein said first double width web travels over said third unwinder to said merger/aligner; and wherein said second double width web travels to said merger/aligner where said slitter slits said second double width web into fourth and fifth single width webs, said fourth and fifth single width webs being fed into said cutter with said first, second and third single width webs.

7. The system of claim 6 further comprising one or more guides mounted to said third unwinder for positioning said first double width web as it travels over said third unwinder.

* * * * *